US011310583B2

(12) United States Patent
Tsubone

(10) Patent No.: US 11,310,583 B2
(45) Date of Patent: Apr. 19, 2022

(54) HEADPHONE DEVICE

(71) Applicant: AUDIO-TECHNICA CORPORATION, Machida (JP)

(72) Inventor: Kodai Tsubone, Machida (JP)

(73) Assignee: AUDIO-TECHNICA CORPORATION, Machida (JP)

( * ) Notice: Subject to any disclaimer, the term of this patent is extended or adjusted under 35 U.S.C. 154(b) by 0 days.

(21) Appl. No.: 17/190,746

(22) Filed: Mar. 3, 2021

(65) Prior Publication Data

US 2021/0289278 A1 Sep. 16, 2021

(30) Foreign Application Priority Data

Mar. 13, 2020 (JP) ..... JP2020-043807

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01)

(58) Field of Classification Search
CPC .... H04R 5/0335; H04R 1/1066; H04R 1/105; H04R 1/10; H04R 1/1041; H04R 1/1058; H04R 1/1008; H04R 5/02
See application file for complete search history.

(56) References Cited

U.S. PATENT DOCUMENTS 5,708,725 A * 1/1998 Ito ..... H04R 5/0335 381/370
2017/0230745 A1* 8/2017 Petersen ..... H04R 1/1008

FOREIGN PATENT DOCUMENTS

JP 2016-082349 A 5/2016

* cited by examiner

*Primary Examiner* — Amir H Etesam
(74) *Attorney, Agent, or Firm* — Manabu Kanesaka

(57) ABSTRACT

Provided is a headphone device including: a pair of headphone units; a headband curved in the longitudinal direction and supporting the pair of headphone units at each end in the longitudinal direction; and a pair of slide mechanisms interposed between the headphone unit and the headband and relatively varying the distance between the headphone unit and the headband, wherein the slide mechanism includes a slide member and a slide guide holding member, the slide member has a pair of slide guides extending in the extending direction of the headband so as to face each other and a plurality of engaging portions are provided along the sliding direction of the slide guides on the side of at least one slide guide facing the other slide guide, and the slide guide holding member includes an engagement urging portion selectively engaged with one of the engaging portions and slidably holds the slide member.

10 Claims, 6 Drawing Sheets

HEADPHONE DEVICE

CROSS REFERENCE TO RELATED APPLICATION

The present application claims the benefit of priority from prior Japanese Patent Application JP 2020-043807, filed Mar. 13, 2020.

FIELD OF THE INVENTION

The present invention relates to a headphone device used for listening to reproduced sound and used by mounting a headphone unit incorporating a driver unit on the head of a user.

BACKGROUND OF THE INVENTION

There has been known a head-mounting type headphone device. This headphone device is provided with a headband curved in accordance with the shape of a human head and a pair of headphone units are respectively supported at each end of the headband.

The headband is provided with a slide mechanism capable of varying the distance to each end and each headphone unit is supported at each end of the headband through the slide mechanism.

In the headphone device provided with such a slide mechanism, the slide mechanism is operated to variably adjust the relative distance between each headphone unit and the headband to adjust the mounting position to the head of a user. The headphone device provided with such a slide mechanism is mounted on the head with a good wearing feeling to various users and provides a good listening environment for reproduced sound.

A headphone device having this kind of slide mechanism is disclosed in Japanese Patent Application Publication No. 2016-82349.

The headphone device disclosed in the above patent document is provided with a headband curved in accordance with the shape of a human head and a pair of headphone units supported at each end of the headband. Each headphone unit is supported by each end of the headband via a headphone support arm. The headphone support arm includes a pair of support arms. With the pair of support arms, the headphone support arm supports the headphone unit so as to vary the support angle with respect to the headband.

To the proximal end of the headphone support arm, a slide member is connected. The slide member constitutes a slide guide mechanism for variably adjusting the relative distance between the headphone unit and the headband.

The slide member is formed as a long rectangular plate-like member and is curved to form an arc in the longitudinal direction. One end in the longitudinal direction of the slide member is held by a holder provided at the end of the headband so as to be movable forward and backward in the longitudinal direction of the headband.

The relative distance between the headphone unit and the headband is varied by advancing/retreating the slide member connected to the headphone support arm to/from the slide guide holding member provided at the end of the headband.

In the headphone device, the relative distance between the headphone unit and the headband is varied to adjust the mounting position of the headphone unit to the head. The headphone device provided with such a mechanism can be worn by various users with a good feeling of wearing and can realize a good listening environment for reproduced sound.

In the headphone device disclosed in the above-mentioned patent document, a positioning mechanism is provided between the slide member and the slide guide holding member. The positioning mechanism intermittently and adjustably positions the slide member with respect to the slide guide holding member so that the relative distance between the headphone unit and the headband is stably maintained.

The positioning mechanism includes a plurality of engaging grooves and an engaging member. The engaging grooves are formed at regular intervals on the inner peripheral side surface of the slide member curved so as to draw an arc in the longitudinal direction and the engaging member is selectively engaged with one of the engaging grooves. The engaging member is formed by bending a plate spring, and has a flat part for fixing to the slide guide holding member and an engaging projection elastically displaceable and selectively engaged with one of the engaging grooves. The engaging projection is elastically urged and pressed against the surface side of the slide member where the engaging grooves are formed, whereby the engaging member is fixed to the slide guide holding member.

In such a headphone device, the engaging projection of the engaging member provided on the slide guide holding member side is elastically displaced and selectively engaged with one of the engaging grooves with the movement of the slide member. In the headphone device, the slide member with is intermittently and adjustably positioned respect to the slide guide holding member by selectively engaging the engaging projection with the engaging groove, thereby varying the relative distance between the headphone unit and the headband.

The slide mechanism provided in the headphone device disclosed in the above-described patent document includes the slide member formed by curving an elastically displaceable thin plate-like metal plate. The slide member has a plurality of engaging grooves on a curved inner peripheral surface. The engaging projection of the elastically displaceable engaging member is selectively engaged with any of the engaging grooves. By this engagement, the relative distance between the headphone unit and the headband is adjusted.

In order to realize a stable moving operation, the slide guide holding member is required to have a constant click feeling which is an intermittent operation feeling. In order to realize the constant click feeling, even when the relative position of the slide member with respect to the slide guide holding member is varied, the engaging groove and the engaging projection are required to be engaged and disengaged with a constant pressing force.

Here, in the slide member in which the elastically displaceable thin plate-like metal plate is formed in a curved shape, variations in machining accuracy are likely to occur such as deviations in the intervals of a plurality of engaging grooves formed on the curved inner peripheral surface. This variation in machining accuracy makes it difficult to engage or disengage the engaging groove and the engaging projection by a constant pressing force. Therefore, in the slide member, a constant intermittent operation feeling (that is, a constant click feeling) with respect to the slide guide holding member tends to be lost.

Further, the slide member is formed in a curved shape in accordance with the shape of a human head. Therefore, when the headphone device is mounted, the curvature of the slide member changes following the opening/closing operation of the headband, and the angle of engagement/disengagement of the engaging projection with/from the engaging groove also changes. The change of the angle makes the pressing force of the engaging projection against the engaging groove unstable. Therefore, it is difficult to stabilize the engagement/disengagement by the pressing force between the engaging groove and the engaging projection. Further, the intermittent operation feeling of the slide member is also degraded.

When the stable moving operation of the slide member is not realized, the slippage of the slide member and the variation of the side pressure of the headphone unit occur when the headphone device is mounted, so that the wearing feeling is degraded.

SUMMARY OF THE INVENTION

An object of the present invention is to provide a headphone device which can be mounted on the head of a user with a good wearing feeling.

Another object of the present invention is to provide a headphone device capable of stably performing variable adjustment of a relative distance between a head band and a headphone unit supported by the headband.

Another object of the present invention is to provide a headphone device capable of easily machining a slide mechanism for variably adjusting the relative distance between the headphone unit and the headband, and of highly accurately adjusting the position of the headphone unit with respect to the headband.

To solve the above described and other problems, a headphone device according to one aspect of the present invention is provided with: a pair of headphone units; a headband formed to be curved in the longitudinal direction and supports the pair of headphone units at each end in the longitudinal direction; and a pair of slide mechanisms interposed between the headphone unit and the headband and relatively varying the distance between the headphone unit and the headband.

The slide mechanism constituting the headphone device is provided with a slide member having a pair of slide guides extending in the extending direction of the headband so as to face each other and a slide guide holding member holding the slide member slidably in the longitudinal direction. At least one surface of the pair of slide guides constituting the slide member facing each other is provided with a plurality of engaging portions along the sliding direction of the slide guides and the slide guides is provided with an engagement urging portion selectively engaged with one of the plurality of engaging portions.

The pair of slide guides of the slide member constituting the headphone device are extended in the extending direction of the headband in parallel with each other, and an engagement urging portion is arranged between the pair of slide guides.

The engagement urging portion urges the engagement in a direction orthogonal to the sliding direction of the slide member and orthogonal to the direction of urging the headband to the head of a user wearing the headphone device.

Further, the pair of slide guides constituting the slide member are formed in a plate shape with wide sides facing each other and are curved along the sliding direction.

In the slide member, the ends of the pair of slide guides in one side are integrally connected by a connecting portion.

Further, the slide member is formed by bending one metal plate, and a pair of slide guides and a connecting portion are integrally formed.

Further, the connecting portion of the slide member is disposed between the pair of slide guide members and is formed integrally with the pair of slide guides by bending one metal plate.

The slide member is preferably supported by the headphone unit and the slide guide holding member is preferably supported by the headband.

The slide member may be supported by the headband and the slide guide holding member may be supported by the headphone unit.

The slide mechanism may be interposed between a headphone support arm pivotally supporting the headphone unit in a direction orthogonal to the longitudinal direction of the headband and the headband.

In the headphone device having the above-described configuration, even when the relative position of the slide member with respect to the engagement urging portion is changed, the relative positional deviation between the engaging portion and the engagement urging portion is suppressed. Therefore, even if the engaging positions of the engaging portions and the engaging urging portions are changed, the pushing pressure by the engaging portions and the engaging urging portions can be made constant. Therefore, mutual engagement and disengagement between the engaging portion and the engagement urging portion are stabilized. The engaging portion and the engagement urging portion are engaged and disengaged by a constant pressing force. Therefore, the moving operation of the headphone unit can be performed in a stable state by a constant intermittent operation feeling. The stable movement operation of the slide member allows the headphone device to be worn on the head with a good wearing feeling.

Further, in the headphone device described above, the slide guide holding member intermittently engaged with one of the engaging portions can be formed with high accuracy. Therefore, the headphone device proposed here can realize a good feeling of operation and a stable movement operation of the headphone unit with respect to the headband, can suppress variations in side pressure, and can be worn with a good feeling of wearing.

Advantages obtained by the present invention will be more apparent from the embodiments described below with reference to the drawings.

DETAILED DESCRIPTION OF PREFERRED EMBODIMENTS

Hereinafter, one embodiment of the headphone device according to the present invention will be described with reference to the drawings. It should be noted that the present invention is not limited to the embodiments described below, but includes appropriately modified embodiments without changing the characteristic configuration thereof.

Figure 1:
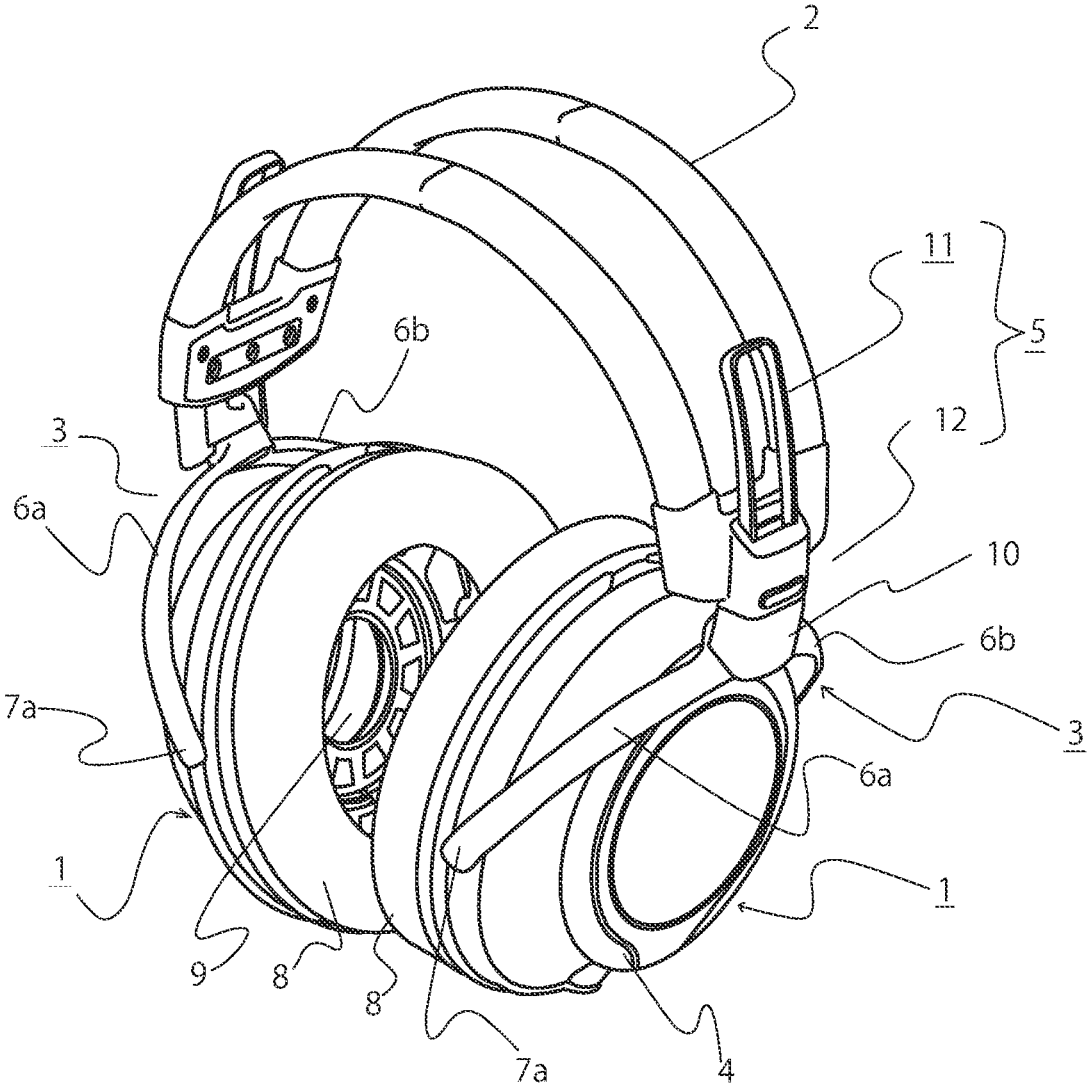
FIG. 1 is a perspective view showing a headphone device according to an embodiment of the present invention.

The headphone device according to the present embodiment is a headphone device of a head-mounting type used by mounting a headphone unit incorporating a driver unit on the head of a user. As shown in FIG. 1, the headphone device includes a pair of right and left headphone units 1, 1 and a headband 2 for supporting the headphone units 1, 1.

The headband 2 is formed with an elastic member such as a long metallic plate spring curved in the longitudinal direction and covered with an outer package. The headband 2 is elastically deformed so as to open and close both ends by varying the curvature. The headphone units 1, 1 are supported at respective ends in the longitudinal direction of the headband 2. The headphone device is mounted to the head of a user by elastic displacement of the headband 2.

In this embodiment, the headphone units 1, 1 are supported by headphone support arms 3, 3, respectively. Through these headphone support arms 3, 3, each of the headphone units 1, 1 is supported at each end of the headband 2.

As shown in FIG. 1, the headphone support arm 3 has a pair of arm portions 6*a*, 6*b*. The pair of arm portions 6*a*, 6*b* are configured to extend along the outer peripheral side of a housing 4 formed in a substantially disk-like shape of the headphone unit 1. The headphone unit 1 is supported at the distal ends of the arm portions 6*a*, 6*b* via support shafts 7*a*, 7*b*.

Figure 2:
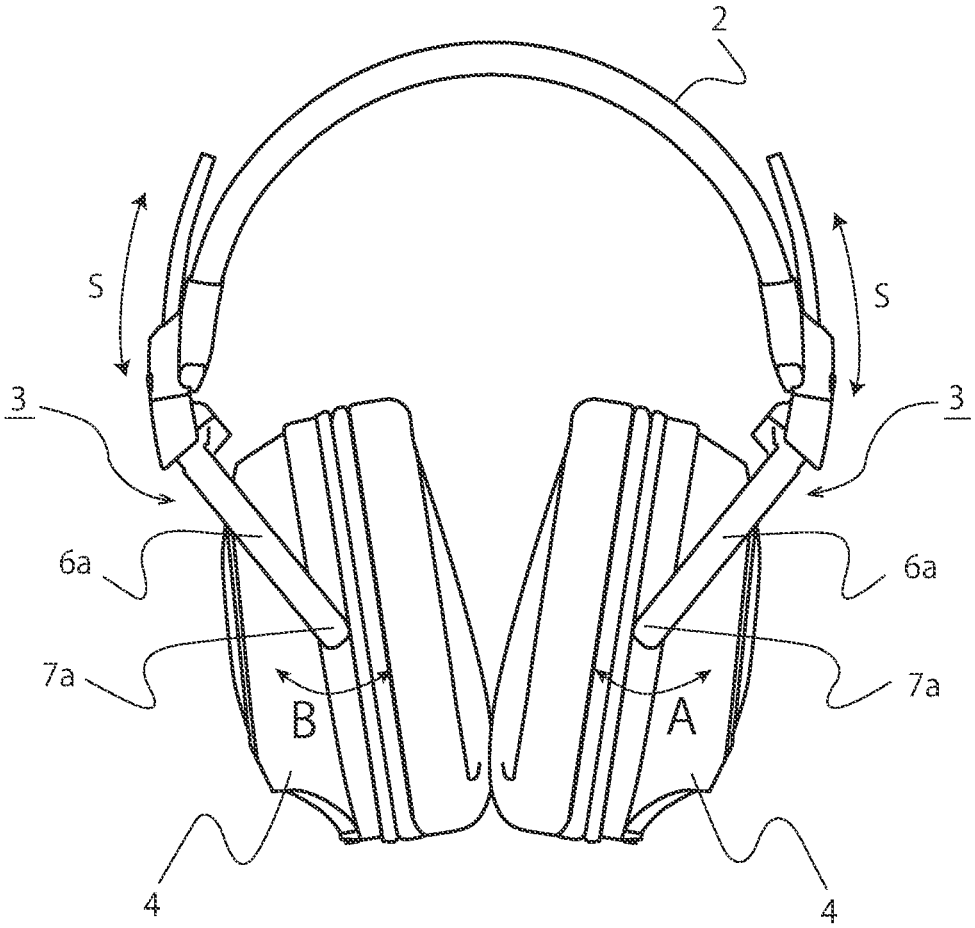
FIG. 2 is a front view of the headphone device shown in FIG. 1.

Here, the headphone units 1, 1 are supported so as to pivot in the direction of arrow A and the direction of arrow B in FIG. 2, in other words, in the direction orthogonal to the longitudinal direction of the headband 2 around the support shafts 7*a*, 7*b*. Therefore, the contact angles of the headphone units 1, 1 with respect to the auricles of the user can be adjusted by pivotally tilting the headphone units 1, 1 around the support shafts 7*a*, 7*b*. Adjusting the abutting angle of the headphone units 1, 1 with respect to the auricle will realize a good wearing feeling for the user.

Between the headphone support arms 3, 3 for supporting the headphone units 1, 1 and respective ends of the headband 2, slide mechanisms 5, 5 for relatively varying the distance between the headphone units 1, 1 and the headband 2 are interposed.

As shown in FIG. 1, the headphone unit 1 used in this embodiment includes an ear pad 8 and a housing 4 incorporating a driver unit 9. In the present embodiment, the ear pad 8 is formed to a size sufficient to cover the entire outer periphery of the auricle when the headphone device is mounted on the head of a user. The driver unit 9 incorporated in the housing 4 is connected to a sound source for supplying an audio signal through a connection cord provided with a connection terminal. The connection terminals are provided on one or both of the pair of right and left headphone units 1, 1. It should be noted that, the headphone device according to the present invention may be a wireless headphone device which receives an audio signal from a sound source via a wireless communication and, in this case, the connection terminal and the connection cord are not necessary.

As described above, the slide mechanisms 5, 5 are respectively provided between each headphone unit 1, 1 and each end of the headband 2. The slide mechanisms 5, 5 connect the headphone units 1, 1 and the headband 2 with the distance therebetween relatively variable.

Figure 3:
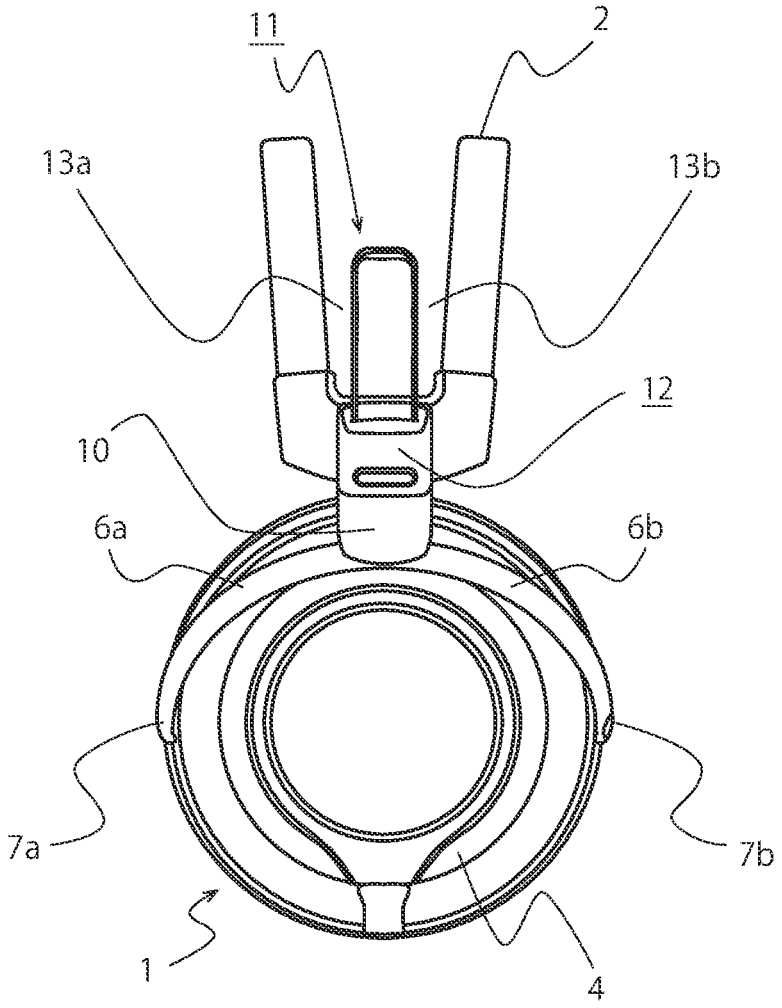
FIG. 3 is a side view of the headphone device shown in FIG. 1.

In this embodiment, as shown in FIGS. 1 and 3, the slide mechanisms 5, 5 respectively include a slide member 11 and a slide guide holding member 12. The distal end of the slide member 11 is connected to an arm connecting portion 10 connecting and supporting the proximal ends of headphone support arms 3, 3 pivotally supporting headphone units 1, 1. The slide guide holding member 12 connected to each end of the headband 2 slidably holds the middle portion of the slide member 11.

That is, in these slide mechanisms 5, 5, slide guide holding members 12, 12 slidably hold the middle portions of the slide members 11, 11. The slide mechanisms 5, 5 enable the user to perform a slide operation, and in the headphone device according to this embodiment, contribute to variable adjustment of the relative distance between each headphone unit 1, 1 and the headband 2.

By variably adjusting the relative distance between each headphone unit 1, 1 and the headband 2, the headphone device according to this embodiment can adjust the fitting position of the pair of left and right headphone units 1, 1 to the head of a user.

As shown in FIGS. 1 and 3, the slide members 11, 11 constituting the slide mechanisms 5, 5 of the present embodiment are disposed between the headphone support arms 3, 3 and the slide guide holding members 12, 12 at each end of the headband 2. The slide members 11, 11 arranged between the headphone support arms 3, 3 and the slide guide holding members 12, 12 are provided with a pair of slide guides 13*a*, 13*b* extending in the extending direction of the headband 2.

Figure 4:
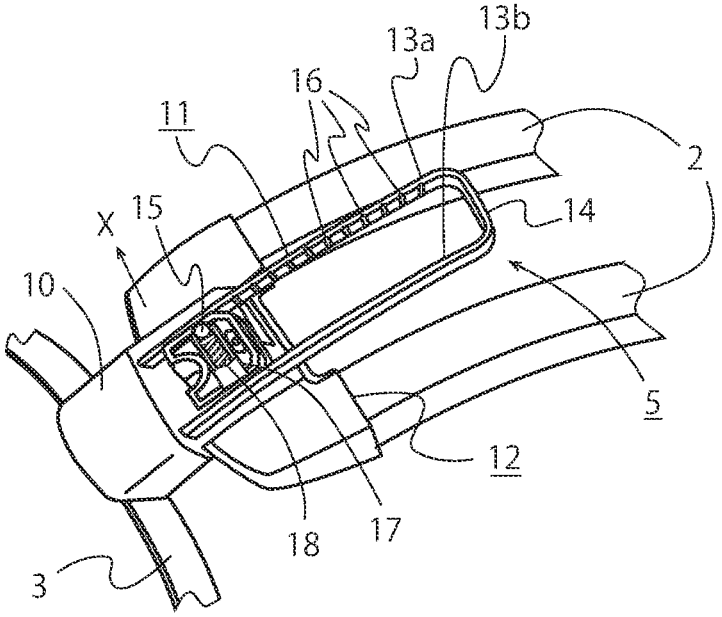
FIG. 4 is a perspective view showing a slide mechanism constituting a headphone device according to an embodiment of the present invention.
Figure 5:
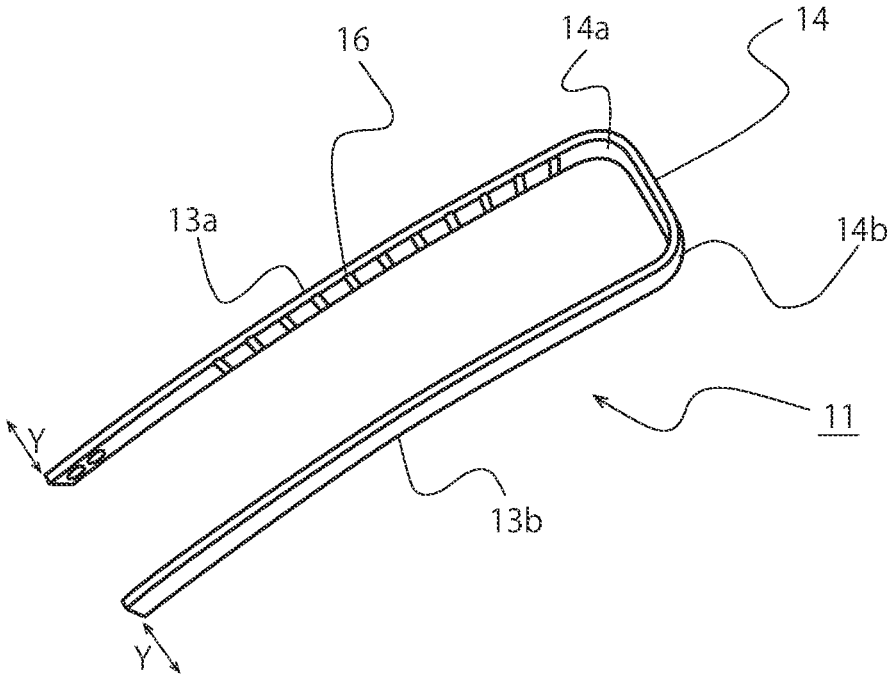
FIG. 5 is a perspective view showing an example of a slide member constituting a headphone device according to an embodiment of the present invention.

These slide guides 13*a*, 13*b* extend in parallel so as to face each other in the extending direction of the headband 2 and are curved in the direction in which the headband 2 is curved. Here, as shown in FIGS. 4 and 5, the proximal ends of the pair of slide guides 13*a*, 13*b* are connected by a connecting portion 14. In the present embodiment, the pair of slide guides 13*a*, 13*b* are formed integrally with the connecting portion 14.

Figure 6:
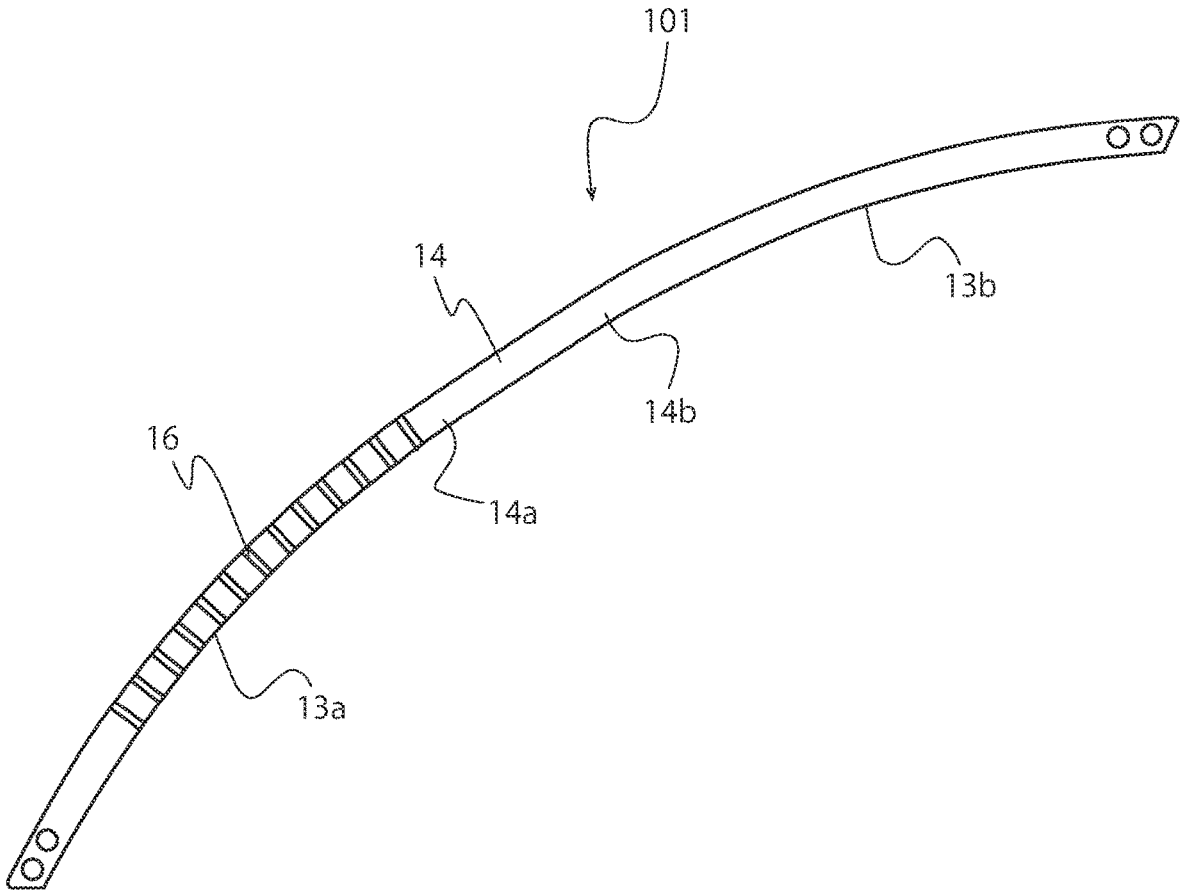
FIG. 6 is a plan view showing a metal plate constituting a slide member of a headphone device according to an embodiment of the present invention.

The slide member 11 used in the present embodiment is made of a metal material, and is formed, for example, by bending an elongated sheet of metal formed by punching a thin stainless-steel sheet. As shown in FIG. 6, a metal plate 101 constituting the slide member 11 includes a pair of slide guides 13*a*, 13*b* and a connecting portion 14 connecting the slide guides 13*a*, 13*b*. The connecting portion 14 is integrally formed in series with the pair of slide guides 13*a*, 13*b*. As shown in FIG. 5, the metal plate 101 is bent along fold lines 14*a*, 14*b* on both sides of the connecting portion 14 so that the bent sides thereof face each other, thereby constituting one slide member 11. That is, the respective pieces bent so as to oppose each other along the fold lines 14*a*, 14*b* around the connecting portion 14 constitute a pair of slide guides 13*a*, 13*b*. Here, the pair of slide guides 13*a*, 13*b* are bent so as to be parallel to each other from the proximal end side connected to the connecting portion 14 to the distal end side.

The pair of slide guides 13*a*, 13*b* connected by the connecting portion 14 are formed so as to be curved symmetrically with respect to the connecting portion 14 to the left and right of the connecting portion 14. In other words, the slide guides 13*a*, 13*b* before bending are formed in an arc shape along the longitudinal direction. As shown in FIG. 5, the curving directions of the pair of slide guides 13*a*, 13*b* coincide with the curving direction of the headband 2 when they are bent so as to be parallel to each other.

As shown in FIGS. 4 and 5, at least one of the opposed inner surfaces of the pair of bent slide guides 13*a*, 13*b* is formed with a plurality of engaging grooves 16. In the present embodiment, the engaging grooves 16 are formed in one slide guide 13*a*. The engaging grooves 16 act as engaging portions to which an engaging projection 15 shown in FIG. 4 selectively engages. In the present embodiment, the engaging projection 15 is constituted by an engagement urging portion incorporated in the slide guide holding member 12. Here, as shown in FIGS. 5 and 6, in the longitudinal direction of the slide guide 13*a*, the plurality of engaging grooves 16 are formed on the inner surface of one slide guide 13*a* in parallel. In the present embodiment, the plurality of engaging grooves 16 are trenched across the width direction of the slide guide 13*a* and are formed parallel to each other.

In the slide members 11, 11 constituting the slide mechanisms 5, 5 of the present embodiment, the pair of slide guides 13*a*, 13*b* connected by the connecting portion 14 are arranged so that the surfaces of the slide guides 13*a*, 13*b* which are wider than the thickness thereof face each other. Therefore, the elastic deformation of the slide guides 13*a*, 13*b* in the direction of the arrow Y in FIG. 5, which is the curved direction, is restricted.

As shown in FIG. 4, the distal ends of the slide members 11, 11 are connected to arm connecting portions 10, 10 which are connected to and support the proximal ends of the headphone support arms 3, 3. Here, the distal ends of the slide members 11, 11 and the arm connecting portions 10, 10 are connected by inserting the slide members 11, 11 into the slide guide holding members 12, 12. The slide guide holding members 12, 12 are connected to respective ends of the headband 2. By inserting the slide members 11, 11 into the slide guide holding members 12, 12, the headband 2 comes to be in a state of supporting the headphone units 1, 1.

As shown in FIG. 4, the slide guide holding members 12, 12 constituting the slide mechanisms 5, 5 of this embodiment are attached to the respective ends of the headband 2. The slide members 11, 11 are respectively connected between the slide guide holding members 12, 12 and the headphone support arms 3, 3.

As described above, each of the slide guide holding members 12, 12 is provided with the engaging projection 15. The engaging projection 15 constitutes an engagement urging portion selectively engaged with one of the plurality of engaging grooves 16. For this purpose, as shown in FIG. 4, the slide guide holding members 12, 12 slidably hold the slide members 11, 11 and urge the slide members 11 in a direction orthogonal to the sliding direction of the arrow S direction in FIG. 2 in which the slide member slides. As a result, the slide guide holding members 12, 12 hold the slide position of the headphone units 1, 1 with respect to the headband and can adjust the position with respect to the headband 2.

The engaging projection 15 used in this embodiment is made of a metallic sphere. The engaging projection 15 is connected to the distal end of an elastic member 18 which is an urging means incorporated in the engaging projection housing 17, receives the urging force of the elastic member 18, and is urged in the direction projecting from the engaging projection housing 17 in the direction indicated by the arrow X in FIG. 4. Here, a part of the engaging projection 15 projects to the outside of the engaging projection housing 17 through a through hole formed in the engaging projection housing 17 by receiving the urging force of the elastic member 18.

When a load is applied, the engaging projection 15 whose part is projected from the engaging projection housing 17 retracts into the engaging projection housing 17, and when the load is released, the engaging projection 15 returns to the position projected from the engaging projection housing 17 by the elastic force of the elastic member 18.

Thus, the engaging projection 15 receives the elastic force of the elastic member 18 and is biased in the direction of the arrow X in FIG. 4, which is the direction of projecting from the outside of the engaging projection housing, and engages with the engaging groove 16 of the slide member 11 in the direction orthogonal to the direction of the arrow S in FIG. 2, which is the sliding direction of the slide member 11. That is, when the engaging projection 15 is positioned in the region of the slide guide 13*a* where the engaging groove 16 is not provided, the engaging projection is brought into a state where it retracts into the engaging projection housing 17 against the urging force of the elastic member 18 by a load applied from the outside of the engaging projection housing 17. Retracting the engaging projection 15 into the engaging projection housing 17 enable the slide member 11 to slide in the sliding direction that is the direction of the arrow S in FIG. 2.

Further, when the slide guide 13*a* is in a position where the engaging groove 16 is provided, the load applied from the outside of the engaging projection housing 17 is released, so that the engaging projection 15 projects from the engaging projection housing 17 by the urging force of the elastic member 18. Then, the engaging projection 15 projecting from the engaging projection housing 17 engages with an engaging groove 16 provided in the slide guides 13*a*.

As described above, the engaging projection 15 provided on the slide guide holding member 12 selectively engages with the plurality of engaging grooves 16 provided on the slide guide 13*a* in accordance with the slide of the slide member 11. Thus, by sliding the slide member 11 with respect to the slide guide holding member 12, the slide position of the slide member 11 with respect to the slide guide holding member 12 can be intermittently changed, thereby relatively changing the distance between the headphone unit 1 supported by the headphone support arm 3 connected to the slide member 11 and the headband 2 connected to the slide guide holding member 12.

In the headphone device according to the present embodiment, the engaging projection 15 serving as the engagement urging portion is urged in a direction orthogonal to the sliding direction of the slide member 11 as well as orthogonal to the direction in which the headband 2 is urged to the head of the user to engage with the engaging groove 16. Thus, the urging force applied when the engaging projection 15 and the engaging groove 16 are engaged is independent from other forces generated when the headphone device is mounted, for example, the urging force received from the headband 2 when the headphone device is mounted on the head. Therefore, when the engaging projection 15 is selectively engaged with or disengaged from any of the plurality of engaging grooves 16, the urging force of the engaging projection 15 to the engaging groove 16 becomes substantially uniform.

On the other hand, in conventional configurations in which the direction of the urging force applied between the slide member slidably supporting the headphone unit and the slide guide holding member holding the slide member by the elastic urging force coincides with the direction in which the pressing force applied to the head by the headband, the urging force applied between the slide member and the slide member varies depending on the amount of deflection of the headband.

On the contrary, the headphone device according to the present embodiment can make the force at the time of variably changing the relative distance between the headphone units 1, 1 and the headband 2 constant without being affected by the change of the urging force due to the deflection of the headband. Therefore, position adjustment of the headphone units 1, 1 with respect to the headband 2 can be stably performed with a constant force at any position. Further, since the urging force for positioning the headphone units 1, 1 relative to the headband 2 is independent of the urging force of the headband 2, the urging force of the headband 2 does not vary by the change of the position of the headphone units 1, 1. Therefore, in the headphone device according to the present embodiment, the headphone device can be mounted to the head of a user with a stable urging force to provide a good wearing feeling.

The slide member 11 used in the present embodiment is formed by bending a long metal plate formed by punching a thin metal material such as a stainless-steel plate. Therefore, the slide member 11 can be manufactured easily, and machining errors in manufacturing can be reduced.

The slide member 11 can be manufactured by punching and bending. Therefore, the slide member 11 can reduce variations in the curved shape of the slide guide, which might occur in a conventional headphone device in which the curved shape of the slide guide is formed by bending by thermal treatment. That is, in the slide member 11 used in the present embodiment, as described above, the shape in which the headband 2 formed in the slide guides 13*a*, 13*b* is curved in the bending direction is predetermined by the punching process, so that variations in the curvature of the curved shape of the slide guide can be reduced. By eliminating variations in the curvatures of the slide guides 13*a*, 13*b*, a headphone device using the slide member 11 can obtain a constant click feeling even when the engaging projection 15 engages with or disengages from any of a plurality of engaging grooves 16 provided in one slide guide 13*a*. Further, in the headphone device, by using the slide member 11 provided with the slide guides 13*a*, 13*b*, when the relative positions of the headphone units 1, 1 with respect to the headband 2 are changed, the variation of the operation feeling can be suppressed and the operation feeling can be made constant.

Further, since the slide member 11 is provided with a configuration in which the opposing surfaces of the pair of slide guides 13*a*, 13*b* are wider than the thickness thereof and face each other, rigidity can be increased. Therefore, the deformation of the slide guides 13*a*, 13*b* due to aging caused by the repeated opening and closing of the headband 2 is suppressed.

Although the slide member 11 of the present embodiment is formed by integrally connecting the pair of slide guides 13*a*, 13*b* via the connecting portion 14, the pair of slide guides 13*a*, 13*b* and the connecting portion 14 may be formed of different materials. For example, the slide member 11 may have a pair of slide guides 13*a*, 13*b* formed of stainless-steel and a connecting portion 14 formed of synthetic resin to connect the slide guides 13*a*, 13*b*.

In the present embodiment, the slide guides 13*a*, 13*b* constituting the slide member 11 may be formed of a member having a shape in which elastic deformation in a curved direction is restricted and may be formed of, for example, a rod-like member having an elliptical cross section. Here, the pair of slide guides 13*a*, 13*b* are arranged so that the long sides of them face each other. The pair of slide guides 13*a*, 13*b* may be formed of a rod-like member having a rectangular cross section. In this case as well, it is desirable that the pair of slide guides 13*a*, 13*b* are disposed such that their surfaces, which are wider than their thicknesses, face each other.

Further, the engaging portion provided on the slide guide holding member 12 to which the engaging projection 15 selectively engages may be any engaging portion to which the engaging projection 15 engages, and may be, for example, through holes serving as engaging holes.

Further, the engaging grooves 16 engaged with the engaging projection 15 may be provided on both of the opposing surfaces of the slide guides 13*a*, 13*b*, respectively. In this case, a pair of the engaging projections 15 engaging with the engaging grooves 16 are provided on the slide guide holding member 12. In this manner, a pair of the engaging projections 15 that engage with the engaging grooves 16 formed in the opposing surfaces of the pair of slide guides 13*a*, 13*b*, respectively, make it possible to move the slide member 11 more stably.

It should be noted that the headphone device according to the present invention may not have the headphone support arms 3, 3 and the housings 4, 4 of the headphone units 1, 1 may be directly connected to the arm connecting portions 10, 10.

Further, the slide mechanisms 5, 5 arranged between the headphone units 1, 1 and the respective ends of the headband 2 may be such that the distal ends of the slide members 11, 11 are connected to the respective ends of the headband 2, and the slide guide holding members 12, 12 are connected to the ends of the headphone units 1, 1, that is, the housing 4.

Specifically, the distal ends of the slide members 11, 11 are connected to the respective ends of the headband 2 and the slide guides 13*a*, 13*b* of the slide members 11 are held by the slide guide holding members 12, 12 connected to the housings 4, 4 of the headphone units 1, 1. Thus, the slide mechanism 5 is disposed between the headphone units 1, 1 and the ends of the headband 2.

The present invention may include a manufacturing method of a slide mechanism. The method may include: punching out an elongated arc-shape slide guide body from a metal plate or sheet, the slide guide body having a pair of slide guides connected by an intermediate connecting portion; forming a plurality of engaging portions on a surface of at least one of the slide guides; and bending both ends of the connecting portion such that the pair of slide guides face each other in parallel.

Therefore, the specific embodiments described above have been shown by way of example, and it should be understood that these embodiments may be susceptible to various modifications and alternative forms.

It should be further understood that the claims are not intended to be limited to the particular forms disclosed, but rather to cover all modifications, equivalents, and alternatives falling within the spirit and scope of this disclosure.

What is claimed is:

1. A headphone device comprising:

a pair of headphone units;

a headband formed to be curved in the longitudinal direction and supports the pair of headphone units at each end in the longitudinal direction; and a pair of slide mechanisms interposed between the headphone unit and the headband for relatively varying the distance between the headphone unit and the headband, wherein the slide mechanism includes:

a slide member;

and a slide guide holding member, wherein the slide member has a pair of slide guides extending in the extending direction of the headband so as to face each other and a plurality of engaging portions are provided along the sliding direction of the pair of slide guides on the side of at least one slide guide facing the other slide guide, and wherein the slide guide holding member includes an engagement urging portion selectively engaged with one of the plurality of engaging portions and slidably holds the slide member.

2. The headphone device according to claim 1, wherein the pair of slide guides are extended in parallel with each other, and wherein the engagement urging portion is arranged between the pair of slide guides.

3. The headphone device according to claim 1, wherein the engagement urging portion urges the engagement in a direction orthogonal to the sliding direction and orthogonal to the direction in which the headband is urged to the head of a user.

4. The headphone device according to claim 1, wherein the pair of slide guides are formed in a plate shape with wide surfaces facing each other and are curved along the sliding direction.

5. The headphone device according to claim 1, wherein the ends of the pair of slide guides are integrally connected by a connecting portion.

6. The headphone device according to claim 5, wherein, in the slide member, the pair of slide guides and a connecting portion for connecting the slide guides are integrally formed of one metal plate.

7. The headphone device according to claim 6, wherein, in the slide member, the one metal plate is bent while the connecting portion is positioned between the pair of slide guides, and the pair of slide guides are connected by the connecting portion.

8. The headphone device according to claim 1, wherein the slide member is supported by the headphone unit and the slide guide holding member is supported by the headband.

9. The headphone device according to claim 1, wherein the slide member is supported by the headband, and the slide guide holding member is supported by the headphone unit.

10. The headphone device according to claim 1, wherein the slide mechanism is interposed between the headband and a headphone support arm pivotally supporting the headphone unit in a direction orthogonal to the longitudinal direction of the headband.

* * * * *